US010119410B2

(12) United States Patent
Rogers et al.

(10) Patent No.: US 10,119,410 B2
(45) Date of Patent: Nov. 6, 2018

(54) VANE SEAL SYSTEM HAVING SPRING POSITIVELY LOCATING SEAL MEMBER IN AXIAL DIRECTION

(71) Applicant: United Technologies Corporation, Hartford, CT (US)

(72) Inventors: Mark J. Rogers, Kennebunk, ME (US); Carl S. Richardson, South Berwick, ME (US); Richard K. Hayford, Cape Neddick, ME (US); Kenneth E. Carman, Kennebunk, ME (US); Jonathan J. Earl, Wells, ME (US)

(73) Assignee: United Technologies Corporation, Farmington, CT (US)

( * ) Notice: Subject to any disclaimer, the term of this patent is extended or adjusted under 35 U.S.C. 154(b) by 402 days.

(21) Appl. No.: 15/026,011

(22) PCT Filed: Sep. 23, 2014

(86) PCT No.: PCT/US2014/056864

§ 371 (c)(1),
(2) Date: Mar. 30, 2016

(87) PCT Pub. No.: WO2015/050739

PCT Pub. Date: Apr. 9, 2015

(65) Prior Publication Data

US 2016/0215637 A1 Jul. 28, 2016

Related U.S. Application Data

(60) Provisional application No. 61/886,237, filed on Oct. 3, 2013.

(51) Int. Cl.
*F01D 11/00* (2006.01)

(52) U.S. Cl.
CPC ..... *F01D 11/001* (2013.01); *F05D 2260/38* (2013.01)

(58) Field of Classification Search
CPC ..... F01D 11/005; F01D 9/041; F01D 11/001; F01D 11/08; F01D 25/04; F05D 2260/38
(Continued)

(56) References Cited

U.S. PATENT DOCUMENTS 4,285,633 A * 8/1981 Jones ..... F01D 11/001 415/191
4,645,424 A 2/1987 Peters
(Continued)

FOREIGN PATENT DOCUMENTS

WO 2013115874 11/2011

OTHER PUBLICATIONS

Supplementary European Search Report for European Application No. 14850123.2 dated Oct. 24, 2017.
(Continued)

*Primary Examiner* — Aaron R Eastman
(74) *Attorney, Agent, or Firm* — Carlson, Gaskey & Olds, P.C.

(57) ABSTRACT

A vane seal system includes a non-rotatable vane segment that has an airfoil with a pocket at one end thereof. The pocket spans in an axial direction between forward and trailing sides, with respect to the airfoil, and in a lateral direction between open lateral sides. A seal member extends in the pocket. The seal member includes a seal element and at least one spring portion that is configured to positively locate the seal member in the axial direction in the pocket. A method for positioning the seal member in a vane seal system includes positively locating the seal member in the axial direction in the pocket using the spring portion.

16 Claims, 2 Drawing Sheets

(58) Field of Classification Search
USPC ..... 415/211.2
See application file for complete search history.

(56) References Cited

U.S. PATENT DOCUMENTS

| | | | |
|---|---|---|---|
| 4,767,267 | A | 8/1988 | Salt et al. |
| 5,346,362 | A | 9/1994 | Bonner et al. |
| 5,715,596 | A | 2/1998 | Bintz |
| 5,785,492 | A | 7/1998 | Belsom et al. |
| 2006/0133928 | A1 | 6/2006 | Bracken et al. |
| 2008/0019836 | A1 | 1/2008 | Butz et al. |
| 2013/0119617 | A1 | 5/2013 | Alvanos et al. |

OTHER PUBLICATIONS

International Search Report for PCT Application No. PCT/US2014/056864 completed Dec. 18, 2014.
International Preliminary Report on Patentability for PCT Application No. PCT/US2014/056864 completed on Apr. 5, 2016.

* cited by examiner

VANE SEAL SYSTEM HAVING SPRING POSITIVELY LOCATING SEAL MEMBER IN AXIAL DIRECTION

CROSS-REFERENCE TO RELATED APPLICATION

This application claims priority to U.S. Provisional Application No. 61/886,237, filed Oct. 3, 2013.

STATEMENT REGARDING GOVERNMENT SUPPORT

This invention was made with government support under contract number FA8650-09-D-2923 awarded by the United States Air Force. The government has certain rights in the invention.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device, such as an epicyclical gear assembly, may be utilized to drive the fan section such that the fan section may rotate at a speed different than the turbine section. In such engine architectures, a shaft driven by one of the turbine sections provides an input to the epicyclical gear assembly that drives the fan section at a reduced speed.

SUMMARY

A vane seal system according to an example of the present disclosure includes a non-rotatable vane segment including an airfoil having at one end thereof a pocket. The pocket spans in an axial direction between forward and trailing sides, with respect to the airfoil, and in a lateral direction between open lateral sides. A seal member extends in the pocket. The seal member includes a seal element and at least one spring portion that is configured to positively locate the seal member in the axial direction in the pocket.

In a further embodiment of any of the foregoing embodiments, the at least one spring portion includes a wave spring.

In a further embodiment of any of the foregoing embodiments, the wave spring includes multiple inflections.

In a further embodiment of any of the foregoing embodiments, the seal member includes a carrier and the seal element is affixed to the carrier, and the at least one spring portion includes a wave spring arranged either forward of or aft of the carrier with respect to the forward and trailing sides of the pocket.

In a further embodiment of any of the foregoing embodiments, the seal member includes a carrier having a base wall defining a first side and an opposed, second side, the base wall having first and second legs that extend outwardly from the first side, and the seal element is affixed to the first side between the first and second legs.

In a further embodiment of any of the foregoing embodiments, the at least one spring portion includes a wave spring arranged against at least one of the first and second legs.

In a further embodiment of any of the foregoing embodiments, the pocket includes first and second hooked arms, and the first and second legs include free ends having radial-facing surfaces that abut respective radial-facing surfaces of the first and second hooked arms.

In a further embodiment of any of the foregoing embodiments, an axial-facing surface of one of the first and second legs abuts an axial-facing surface of one of the first and second hooked arms.

In a further embodiment of any of the foregoing embodiments, the seal element includes a porous body.

In a further embodiment of any of the foregoing embodiments, the seal member includes a base wall, and the seal element is affixed to the base wall, with a spring leg extending at one end of the base wall.

A vane seal system according to an example of the present disclosure includes first and second non-rotatable adjacent vane segments including respective first and second airfoils having at ends thereof respective first and second pockets. The first and second pockets span in an axial direction between forward and trailing sides, with respect to the airfoils, and in a lateral direction between open lateral sides. A seal member extends in the first and second pockets. The seal member includes a seal element and at least one spring portion configured to positively locate the seal member in the axial direction in the first and second pockets.

In a further embodiment of any of the foregoing embodiments, the spring member extends across a gap between the first and second pockets.

In a further embodiment of any of the foregoing embodiments, the at least one spring portion includes a wave spring.

In a further embodiment of any of the foregoing embodiments, the seal member includes a carrier and the at least one spring portion is arranged between a forward or trailing side of the carrier and, respectively, the forward or trailing sides of the first and second pockets.

In a further embodiment of any of the foregoing embodiments, the at least one spring portion is in frictional contact with sides of the first pocket and the second pocket such that the at least one spring portion damps relative movement between the first pocket and the second pocket.

In a further embodiment of any of the foregoing embodiments, the seal member includes a base wall, and the seal element is affixed to the base wall, and the at least one spring portion includes a spring leg extending from one end of the base wall.

In a further embodiment of any of the foregoing embodiments, the seal member includes a carrier having a base wall defining a first side and an opposed, second side, the base wall having first and second legs that extend outwardly from the first side, and the seal element is affixed to the first side between the first and second legs.

In a further embodiment of any of the foregoing embodiments, the at least one spring portion includes a wave spring arranged against at least one of the first and second legs.

In a further embodiment of any of the foregoing embodiments, the first and second pockets each include first and second hooked arms, and the first and second legs include free ends having radial-facing surfaces that abut respective radial-facing surfaces of the first and second hooked arms.

In a further embodiment of any of the foregoing embodiments, an axial-facing surface of one of the first and second legs abuts an axial-facing surface of one of the first and second hooked arms.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
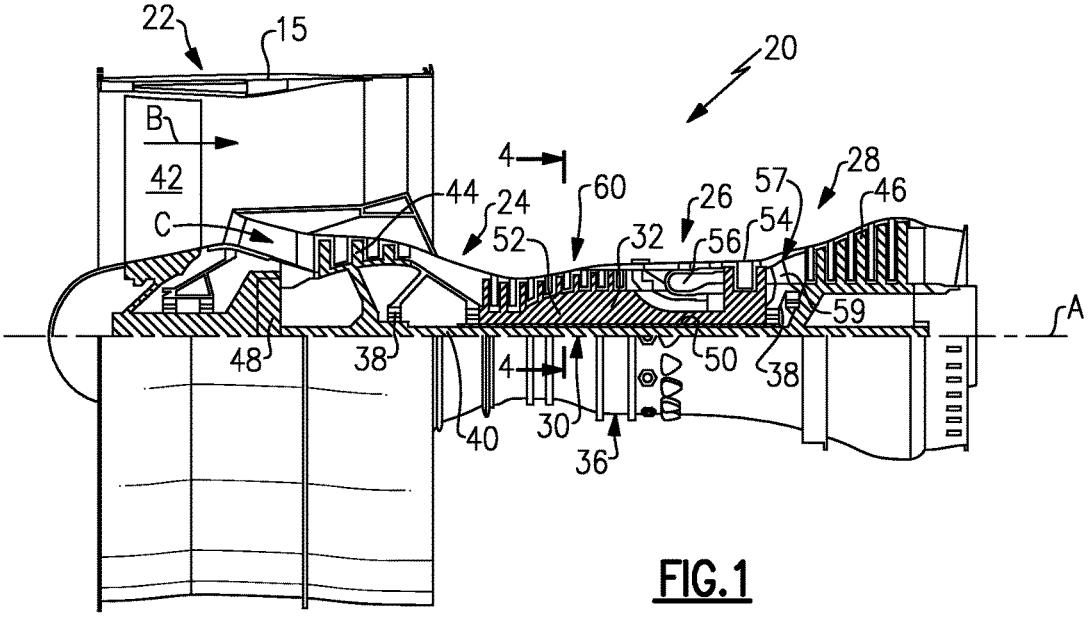
FIG. 1 illustrates an example gas turbine engine.

FIG. 1 schematically illustrates a gas turbine engine 20. The gas turbine engine 20 is disclosed herein as a two-spool turbofan that incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it is to be understood that the concepts described herein are not limited to use with two-spool turbofans and the teachings can be applied to other types of turbine engines, including three-spool architectures and ground-based engines.

The engine 20 includes a low speed spool 30 and a high speed spool 32 mounted for rotation about an engine central axis A relative to an engine static structure 36 via several bearing systems, shown at 38. It is to be understood that various bearing systems at various locations may alternatively or additionally be provided, and the location of bearing systems may be varied as appropriate to the application.

The low speed spool 30 includes an inner shaft 40 that interconnects a fan 42, a low pressure compressor 44 and a low pressure turbine 46. The inner shaft 40 is connected to the fan 42 through a speed change mechanism, which in this example is a gear system 48, to drive the fan 42 at a lower speed than the low speed spool 30. The high speed spool 32 includes an outer shaft 50 that interconnects a high pressure compressor 52 and high pressure turbine 54.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A combustor 56 is arranged between the high pressure compressor 52 and the high pressure turbine 54. A mid-turbine frame 57 of the engine static structure 36 is arranged between the high pressure turbine 54 and the low pressure turbine 46. The mid-turbine frame 57 further supports bearing system 38 in the turbine section 28. The inner shaft 40 and the outer shaft 50 are concentric and rotate via, for example, bearing systems 38 about the engine central axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and gear system 48 can be varied. For example, gear system 48 may be located aft of combustor section 26 or even aft of turbine section 28, and fan section 22 may be positioned forward or aft of the location of gear system 48.

The engine 20 in one example is a high-bypass geared engine. In a further example, the engine 20 has a bypass ratio that is greater than about six (6), with an example embodiment being greater than about ten (10), the gear system 48 is an epicyclic gear train, such as a planet or star gear system, with a gear reduction ratio of greater than about 2.3, and the low pressure turbine 46 has a pressure ratio that is greater than about five (5). In one disclosed embodiment, the bypass ratio is greater than about ten (10:1), the fan diameter is significantly larger than that of the low pressure compressor 44, and the low pressure turbine 46 has a pressure ratio that is greater than about five (5). Low pressure turbine 46 pressure ratio is pressure measured prior to inlet of low pressure turbine 46 as related to the pressure at the outlet of the low pressure turbine 46 prior to an exhaust nozzle. The gear system 48 can be an epicycle gear train, such as a planet or star gear system, with a gear reduction ratio of greater than about 2.3:1. It is to be understood, however, that the above parameters are only exemplary and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\text{R})/(518.7\ ^\circ\text{R})]^{0.5}$. The "Low corrected fan tip speed" as disclosed herein according to one non-limiting embodiment is less than about 1150 ft/second.

The fan 42, in one non-limiting embodiment, includes less than about twenty-six fan blades. In another non-limiting embodiment, the fan section 22 includes less than about twenty fan blades. Moreover, in a further example, the low pressure turbine 46 includes no more than about six turbine rotors. In another non-limiting example, the low pressure turbine 46 includes about three turbine rotors. A ratio between the number of fan blades and the number of low pressure turbine rotors is between about 3.3 and about 8.6 . The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Various sections of the engine 20 can include one or more stages of circumferentially-arranged, non-rotatable stator vanes and rotatable blades. For example, the high pressure compressor 52 can include one or more of such stages. Although the examples herein may be described with respect to the high pressure compressor 52, it is to be understood that this disclosure is not limited to the high pressure compressor 52 and that the low pressure compressor 44 and the sections of the turbine 28 can also benefit from the examples herein.

Figure 2:
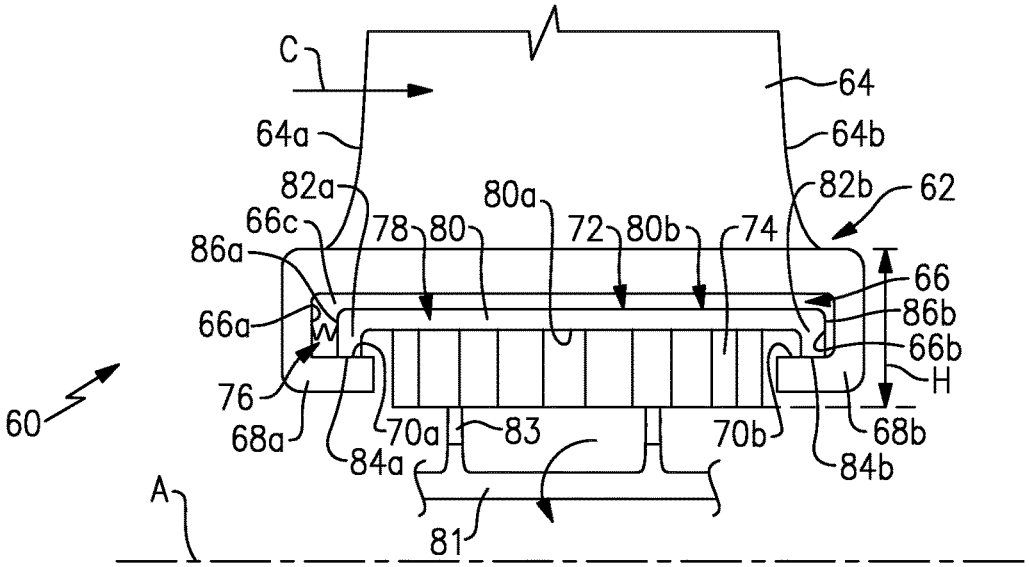
FIG. 2 illustrates selected portions of a vane seal system of the gas turbine engine of FIG. 1.

In this example, the high pressure compressor 52 includes one or more vane seal systems 60 (shown schematically), which is shown in isolated view in FIG. 2. The vane seal system 60 includes a non-rotatable vane segment 62. The vane segment 62 includes an airfoil 64 that has at one end thereof a pocket 66. In this example, the pocket 66 is at the radially inner end of the airfoil 64, relative to the central engine axis, A. It is to be understood, however, that the pocket 66 could alternatively be located at a radially-outer end of the airfoil 64.

Relative to the core flow path C through the engine 20, the airfoil 64 has a leading end 64*a* and a trailing end 64*b*. Relative to this orientation, the pocket 66 has a forward side 66*a* and a trailing side 66*b*. The pocket 66 also spans in a lateral/circumferential direction between open lateral sides 66*c* (one shown). Thus, the pocket 66 opens on each lateral side 66*c* to pockets of the immediately adjacent airfoils in the engine 20.

The pocket 66 is defined by first and second hooked arms 68*a*/68*b*. The hooked arms 68*a*/68*b* include the forward and trailing side 66*a*/66*b* of the pocket 66 and also define radially-facing surfaces 70*a*/70*b*. In this example, the radially-facing surfaces 70*a*/70*b* face radially outward relative to the central engine axis, A.

A seal member 72 extends in the pocket 66. The seal member 72 includes a seal element 74 and at least one spring portion 76. With respect to the leading and trailing ends 64*a*/64*b* of the airfoil 64 and the engine central axis, A, there is an axial direction between the forward and trailing sides 66*a*/66*b* of the pocket 66. The spring portion 76 is configured to bias the seal member 72 in the axial direction. In this manner, the spring portion 76 serves to positively locate the seal member in the pocket 66.

In this example, the seal member 72 includes a carrier 78 having a base wall 80 that has a first side 80*a* and a second, opposed side 80*b*. The carrier can be made a nickel-based alloy, a titanium-based alloy, an aluminum-based alloy, or iron-based alloy, but is not limited to such alloys. The base wall 80 includes legs 82*a*/82*b* at the respective forward and trailing ends. The legs 82*a*/82*b* extend inwardly toward the axis A, from the first side 80*a*. The seal element 74 is affixed to the first side 80*a* of the base wall 80 between the legs 82*a*/82*b*. For example, the seal element 74 is brazed to, welded to, or adhesively bonded to the base wall 80. This arrangement provides a relatively compact structure that can facilitate reduction in a height, H, that the sealing system occupies. The reduction in height compared to other types of seal arrangements can also reduce heat that can collect in sealing areas. The seal element 74, at least in operation of the engine 20, contacts a mating rotatable seal element 81, which in the illustrated example includes a plurality of knife edges 83 that are mounted on a rotor and seal against the seal element 74. The seal element 74 can be a porous element, such as, but not limited to, a honeycomb structure, a porous sintered metal or other porous body. In a modified example, the knife edges 83 could instead be provided on the seal member 72 and the seal element 74 on the rotor.

The legs 82*a*/82*b* each include free ends that have radially-facing surfaces 84*a*/84*b* that abut, respectively, radially-facing surfaces 70*a*/70*b* of the first and second hooked arms 68*a*/68*b*. The legs 82*a*/82*b* also include axially-facing surfaces 86*a*/86*b*. In this example, the axially-facing surface 86*b* abuts axially-facing side 66*b* of the pocket 66. The three areas of abutment, including abutment between surfaces 70*a*/84*a*, 70*b*/84*b* and 66*b*/86*b*, provides frictional contact between the carrier 78 and the pocket 66. The frictional contact serves to dampen vibrational or other movement of the pocket 66 during engine operation. Moreover, the total area of contact can be configured to achieve a greater or lesser degree of damping.

In the illustrated example, the spring portion 76 includes a wave spring that is situated between the leg 82*a* and the forward side 66*a* of the pocket 66. Alternatively, the wave spring could be provided at the aft end between axially-facing surface 86*b* and the trailing side 66*b* of the pocket 66. The wave spring includes multiple inflections and is resilient to provide a constant positive location force against the carrier 78. The number and curvature of the inflections can be configured to provide a desired spring force on the carrier 78. Thus, the spring force can be tuned according to a particular design and spatial volume available. Moreover, the spring force can be tuned in combination with the three areas of abutment, including abutment between surfaces 70*a*/84*a*, 70*b*/84*b* and 66*b*/86*b*, to provide a desired degree of damping.

Figure 3:
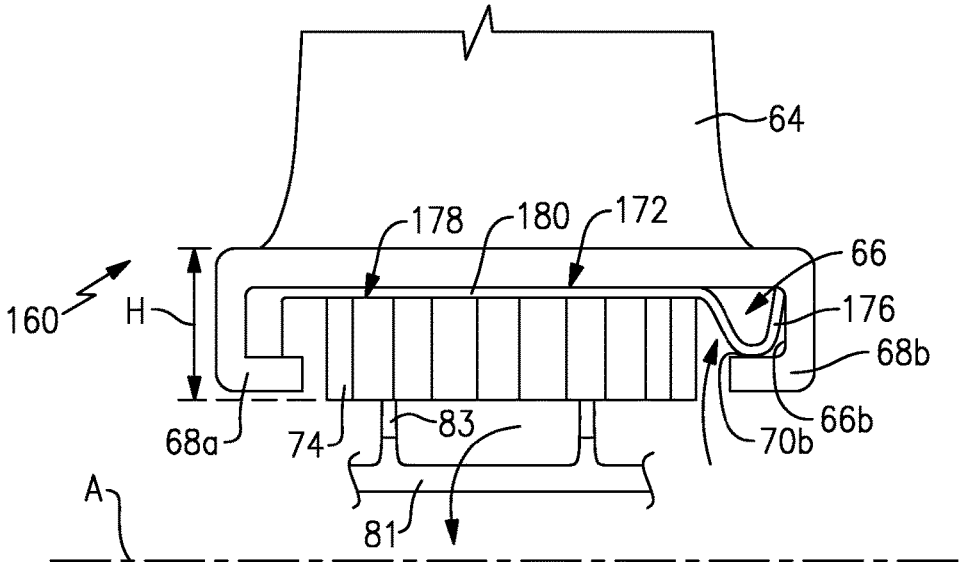
FIG. 3 illustrates another example vane seal system.

FIG. 3 illustrates a modified example of a vane seal system 160. In this disclosure, like reference numerals designate like elements where appropriate and reference numerals with the addition of one-hundred or multiples thereof designate modified elements that are understood to incorporate the same features and benefits of the corresponding elements. In this example, the seal member 172 includes a carrier 178 having base wall 80, but rather than the separate wave spring, an axial spring leg 176 is integrated with the base wall 180. The axial spring leg 176 abuts axially-facing surface 66*b* of the pocket 66 and also abuts radially-facing surface 70*b* of the hooked arm 68*b*. The axial spring leg 176 is resilient and thus positively locates the seal member 172 in the axial direction in the pocket 66. Additionally, the frictional contact between the axial spring leg 176 and the surfaces 70*b*/66*b* also dampens vibrations or other movement of the pocket 66.

Figure 4:
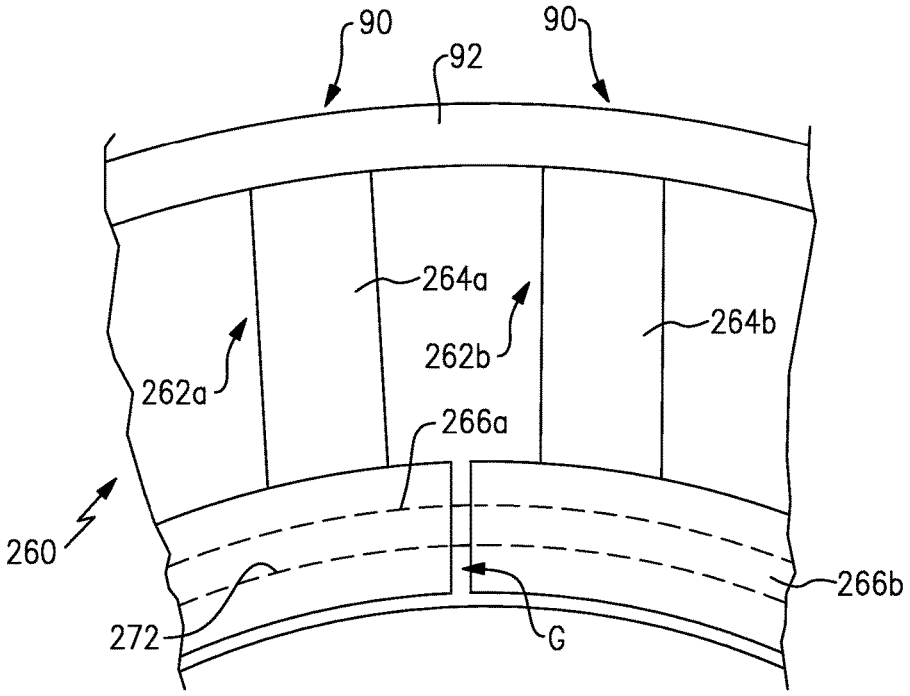
FIG. 4 illustrates another example vane seal system having a seal member that spans between at least two pockets.

The seal member 72/172 can be used exclusively in a single pocket or can be used as a common seal member that extends in two or more adjacent pockets, as shown in FIG. 4. Referring to FIG. 4, a vane seal system 260 includes first and second non-rotatable adjacent vane segments 262*a*/262*b*. Each of the vane segments 262*a*/262*b* includes airfoils 264*a*/264*b* with first and second pockets 266*a*/266*b* at respective ends thereof. Although the vane sealing system 260 is shown with two vane segments 262*a*/262*b*, it is to be understood that additional vane segments could be used. The vane segments 262*a*/262*b* are joined at their outer ends 90 by an outer wall 92, which can be attached to a case structure in a known manner. The inner ends are split at a gap, G. Thus, although the vane segments 262*a*/262*b* are rigidly secured at the outer ends 90, the inner ends at the pockets 266*a*/266*b* are permitted to move in response to aerodynamic forces, for example, such that the pockets 266*a*/266*b* vibrate or otherwise move relative to one another. The seal member 272 spans across the gap, G and in each of the pockets 262*a*/262*b*. Thus, the seal member 272 is common between the vane segments 262*a*/262*b*. By using the seal member 272 that spans between the pockets 266*a*/266*b*, the relative movement between the pockets 266*a*/266*b* can be mitigated by the frictional contact between the seal member 272 and the walls of the pockets 266*a*/266*b*, as described in the examples above. Thus, when the pockets 266*a*/266*b* move relative to one another, the kinetic energy of the movement is at least partially dissipated through the friction of the seal member 272 and the production of heat.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vane seal system comprising:

a non-rotatable vane segment including an airfoil having at one end thereof a pocket, the pocket spanning in an axial direction between forward and trailing sides, with respect to the airfoil, and in a lateral direction between open lateral sides;

a seal member extending in the pocket, the seal member including a seal element and at least one spring portion configured to positively locate the seal member in the axial direction in the pocket;

wherein the seal member includes a carrier having a base wall defining a first side and an opposed, second side, the base wall having first and second legs that extend outwardly from the first side, and the seal element is affixed to the first side between the first and second legs; and wherein the pocket includes first and second hooked arms, and the first and second legs include free ends having radial-facing surfaces that abut respective radial-facing surfaces of the first and second hooked arms.

2. The vane seal system as recited in claim 1, wherein the at least one spring portion includes a wave spring.

3. The vane seal system as recited in claim 2, wherein the wave spring includes multiple inflections.

4. The vane seal system as recited in claim 1, wherein the seal member includes a carrier and the seal element is affixed to the carrier, and the at least one spring portion includes a wave spring arranged either forward of or aft of the carrier with respect to the forward and trailing sides of the pocket.

5. The vane seal system as recited in claim 1, wherein the at least one spring portion includes a wave spring arranged against at least one of the first and second legs.

6. The vane seal system as recited in claim 1, wherein an axial-facing surface of one of the first and second legs abuts an axial-facing surface of one of the first and second hooked arms.

7. The vane seal system as recited in claim 1, wherein the seal element includes a porous body.

8. The vane seal system as recited in claim 1, wherein the seal member includes a base wall, and the seal element is affixed to the base wall, with a spring leg extending at one end of the base wall.

9. A vane seal system comprising:

first and second non-rotatable adjacent vane segments including respective first and second airfoils having at ends thereof respective first and second pockets, the first and second pockets spanning in an axial direction between forward and trailing sides, with respect to the airfoils, and in a lateral direction between open lateral sides;

a seal member extending in the first and second pockets, the seal member including a seal element and at least one spring portion configured to positively locate the seal member in the axial direction in the first and second pockets;

wherein the seal member includes a carrier having a base wall defining a first side and an opposed, second side, the base wall having first and second legs that extend outwardly from the first side, and the seal element is affixed to the first side between the first and second legs; and wherein the first and second pockets each include first and second hooked arms, and the first and second legs include free ends having radial-facing surfaces that abut respective radial-facing surfaces of the first and second hooked arms.

10. The vane seal system as recited in claim 9, wherein the spring member extends across a gap between the first and second pockets.

11. The vane seal system as recited in claim 9, wherein the at least one spring portion includes a wave spring.

12. The vane seal system as recited in claim 9, wherein the seal member includes a carrier and the at least one spring portion is arranged between a forward or trailing side of the carrier and, respectively, the forward or trailing sides of the first and second pockets.

13. The vane seal system as recited in claim 9, wherein the at least one spring portion is in frictional contact with sides of the first pocket and the second pocket such that the at least one spring portion damps relative movement between the first pocket and the second pocket.

14. The vane seal system as recited in claim 9, wherein the seal member includes a base wall, and the seal element is affixed to the base wall, and the at least one spring portion includes a spring leg extending from one end of the base wall.

15. The vane seal system as recited in claim 9, wherein the at least one spring portion includes a wave spring arranged against at least one of the first and second legs.

16. The vane seal system as recited in claim 9, wherein an axial-facing surface of one of the first and second legs abuts an axial-facing surface of one of the first and second hooked arms.

* * * * *